US006085055A

United States Patent [19]

Shin et al.

[11] Patent Number: 6,085,055

[45] Date of Patent: Jul. 4, 2000

[54] CARRIER RECOVERY APPARATUS OF LIQUID ELECTROPHOTOGRAPHIC PRINTER

[75] Inventors: Seong-soo Shin; Un-ho Baik, both of Yongin, Rep. of Korea

[73] Assignee: Samsung Electronics Co., Ltd., Kyungki-do, Rep. of Korea

[21] Appl. No.: 09/275,429

[22] Filed: Mar. 24, 1999

[30] Foreign Application Priority Data

Mar. 24, 1998 [KR] Rep. of Korea ..... 98-10160
Mar. 24, 1998 [KR] Rep. of Korea ..... 98-10161

[51] Int. Cl.[7] ..... G03G 15/10
[52] U.S. Cl. ..... 399/250
[58] Field of Search ..... 399/249–251; 430/117–119; 261/123, 122.1

[56] References Cited

U.S. PATENT DOCUMENTS 5,884,128 3/1999 Park ..... 399/250
5,905,928 5/1999 Shin ..... 399/250

*Primary Examiner*—Arthur T. Grimley
*Assistant Examiner*—Quana Grainger
*Attorney, Agent, or Firm*—Sughrue, Mion, Zinn, Macpeak & Seas, PLLC

[57] ABSTRACT

A carrier recovery apparatus of a liquid electrophotographic printer including a dry roller which contacts a photoreceptor belt, for absorbing a liquid carrier therefrom, a heating roller for heating the dry roller and evaporating the carrier, a manifold for hermetically sealing and surrounding the dry roller and the heating roller so as to accommodate the evaporated gas carrier, a circulation line for connecting an outlet and an inlet formed in the manifold to form a closed loop, along which the gas carrier accommodated in the manifold circulates, a driving fan for supplying a driving force which allows the gas carrier to circulate, and a condensing means installed in the circulation line, for cooling and condensing the circulating gas carrier and transmitting the condensed carrier to a cartridge.

20 Claims, 9 Drawing Sheets

CARRIER RECOVERY APPARATUS OF LIQUID ELECTROPHOTOGRAPHIC PRINTER

BACKGROUND OF THE INVENTION

1. Field of the Invention

The present invention relates to an apparatus for recovering a carrier from a photoreceptor belt in a liquid electrophotographic printer.

2. Description of the Related Art

An electrophotographic printer such as a laser color printer develops and prints an electrostatic latent image using a developer liquid in which a powdered toner is mixed with a liquid carrier. Referring to FIG. 1, a conventional liquid electrophotographic printer includes a printing unit 10 for transmitting an image to a sheet 1 by a photoreceptor belt 14 as a photosensitive medium, and a carrier recovery apparatus 20 for removing a liquid carrier from the photoreceptor belt 14 and recovering the same.

The printing unit 10 includes a photoreceptor belt 14 mounted on and circulated by a plurality of guide rollers 11, 12 and 13, laser scanning units 18*a*, 18*b*, 18*c* and 18*d* for forming a latent electrostatic image on the photoreceptor belt 14, and development devices 15*a*, 15*b*, 15*c* and 15*d* for developing the latent electrostatic image by applying a developer liquid having a carrier mixed with a toner, and a transfer roller 16 for transferring the developed image onto a sheet 1.

Referring to FIG. 2 showing a detailed diagram of the carrier recovery apparatus 20, first, in a manifold 21, there are provided a drying roller 22 for absorbing the liquid carrier from a photoreceptor belt 14 while rotating in contact with the photoreceptor belt 14, and at least one heating roller 23 for heating the drying roller in contact therewith and evaporating the absorbed carrier. Some of the evaporated gas carrier is condensed on the inner surface of the manifold 21 into liquid form and then induced to a cartridge 26 through a first recovery tube 25.

Also, the uncondensed gas carrier of the manifold 21 is induced to a condenser 28 along a supply line 27 by the driving of a supply fan 29. Since a liquid condensed carrier 28*a* is contained in the condenser 28, the induced gas carrier is liquefied by heat exchange with the condensed carrier 28*a*. If the surface level of the carrier is raised by the condensation of the gas carrier, some of the condensed carrier is recovered in the cartridge 26 through a second recovery tube 31.

Also, the gas carrier which is not condensed in the condenser 28 is filtered by a filter 30 while it is exhausted to the outside together with the air. Reference numeral 19 represents an exhaust line leading to the outside via the filter 30, for removing moisture in the printing unit 10, reference numerals 32 and 33 represent a drain line and a moisture separation container, respectively, for separating moisture from the liquid carrier 28*a* stored in the condenser 28.

In the conventional carrier recovery apparatus, the gas carrier which is not condensed in the condenser 28 is filtered by the filter 30. Therefore, if the filtering capacity of the filter 30 is lowered, some of the gas carrier may be effused to the outside. The effused carrier causes environmental pollution. Therefore, it is necessary to suppress the efflux of the carrier.

SUMMARY OF THE INVENTION

To solve the above problems, it is an objective of the present invention to provide an improved carrier recovery apparatus of a liquid electrophotographic printer which can suppress the efflux of a carrier by increasing the carrier recovery efficiency.

Accordingly, to achieve the above objective, there is provided a carrier recovery apparatus of a liquid electrophotographic printer including a dry roller being in contact with a photoreceptor belt, for absorbing a liquid carrier therefrom, a heating roller for heating the dry roller and evaporating the carrier, a manifold for hermetically sealing and surrounding the dry roller and the heating roller so as to accommodate the evaporated gas carrier, a circulation line for connecting an outlet and an inlet formed in the manifold to form a closed loop, along which the gas carrier accommodated in the manifold circulates, a driving fan for supplying a driving force which allows the gas carrier to circulate, and a condensing means installed in the circulation line, for cooling and condensing the circulating gas carrier and transmitting the condensed carrier to a cartridge.

The condensing means includes a carrier cooling portion for cooling and liquefying the gas carrier, a heat emitting portion for emitting the heat absorbed from the carrier cooling portion, a heat exchanging device interposed between the carrier cooling portion and the heat emitting portion, for performing heat exchange, and a cooling fan for cooling the heat emitting portion.

Here, the carrier cooling portion preferably includes a plurality of cooling fins.

Further, metal balls may be further installed between the cooling fins.

According to another aspect of the present invention, the carrier cooling portion is formed of a porous medium having a high heat conductivity, preferably, a metal sponge.

According to still another aspect of the present invention, the carrier cooling portion is positioned at an upstream position of the circulation line and the heat emitting portion is positioned at a downstream position thereof.

BRIEF DESCRIPTION OF THE DRAWINGS

The above objective and advantages of the present invention will become is more apparent by describing in detail a preferred embodiment thereof with reference to the attached drawings in which.

DESCRIPTION OF THE PREFERRED EMBODIMENTS

Figure 1:
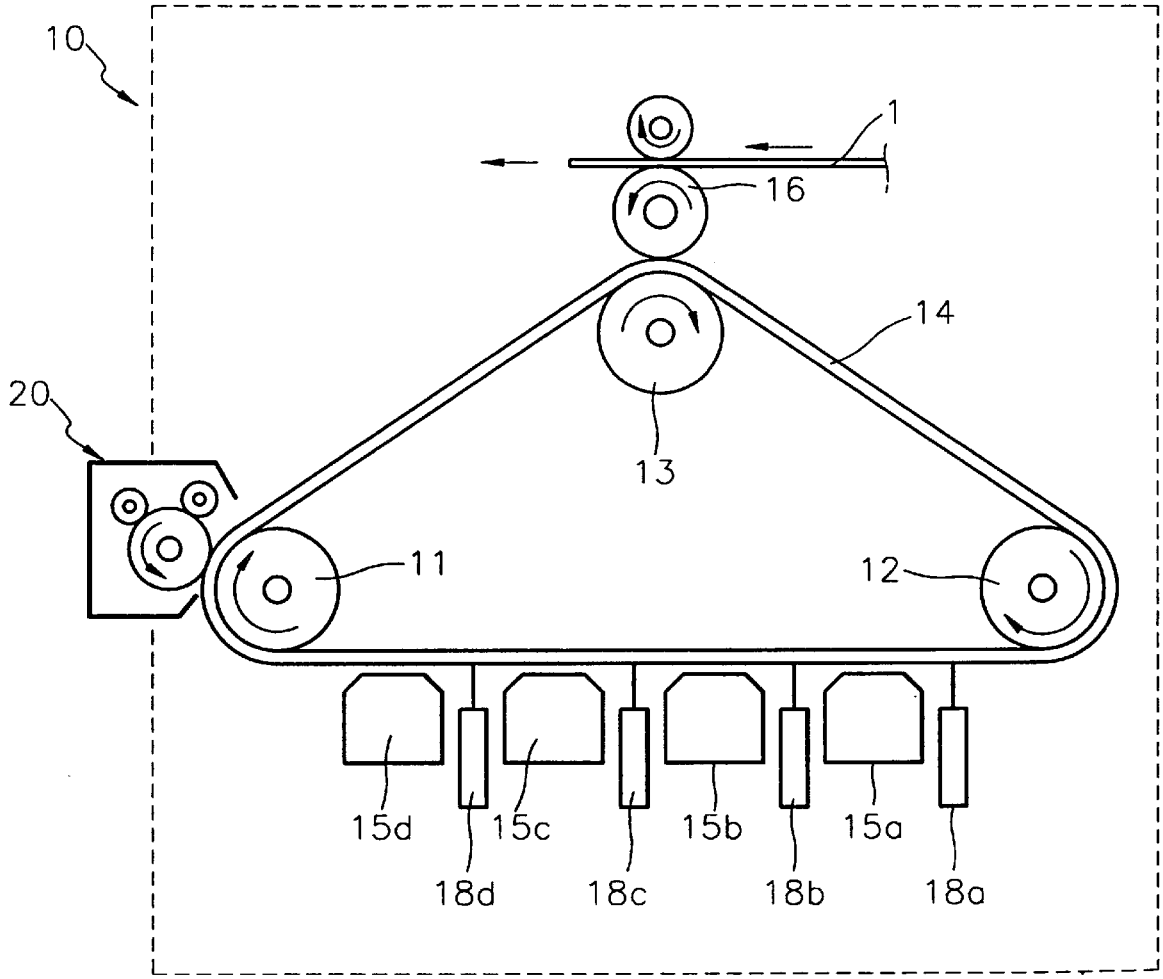
FIG. 1 (PRIOR ART)
FIG. 1 is a schematic diagram illustrating the structure of a conventional liquid electrophotographic printer.
Figure 2:
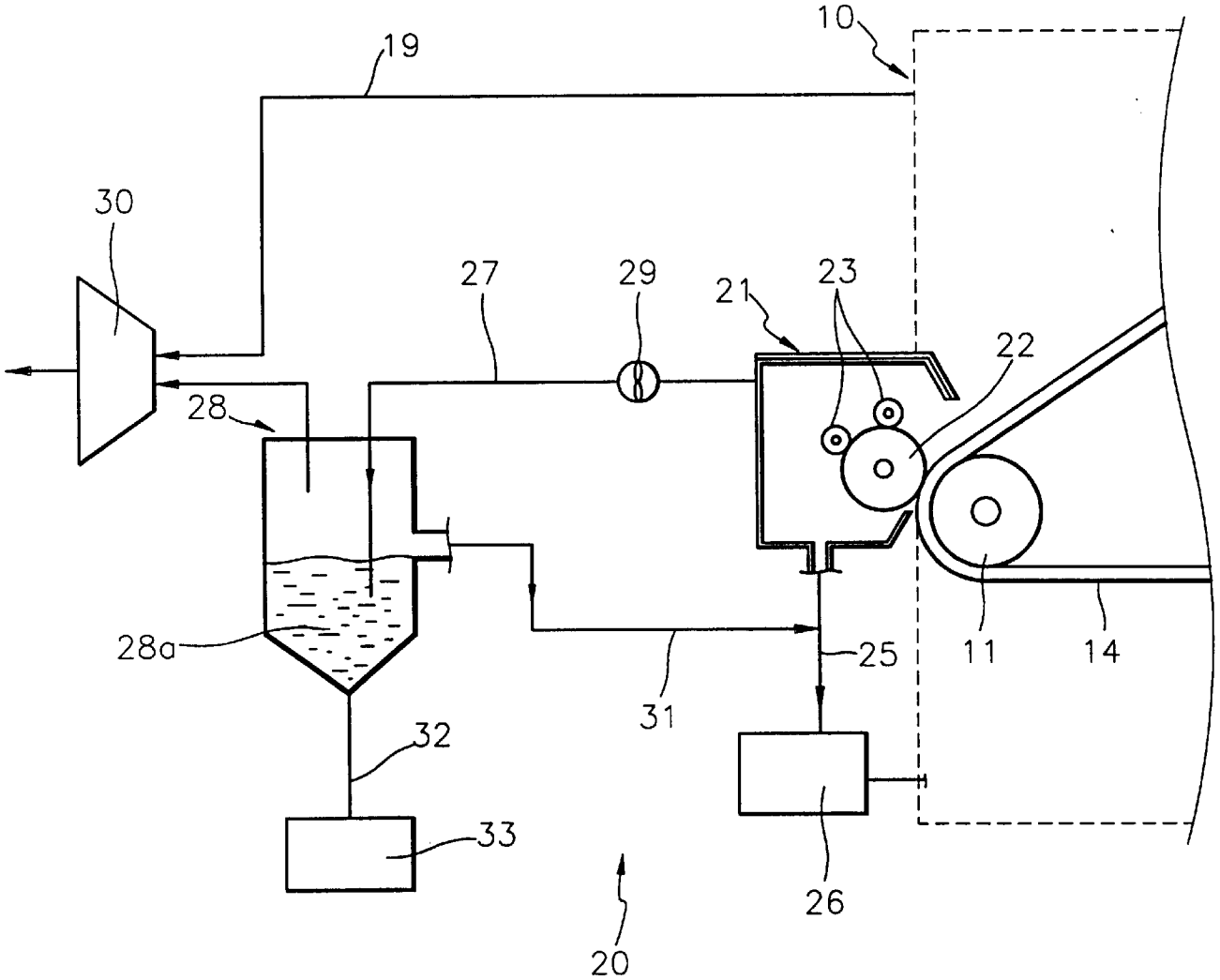
FIG. 2 (PRIOR ART)
FIG. 2 is a schematic diagram of a conventional carrier recovery 20 employed in the liquid electrophotographic printer shown in FIG. 1.
Figure 3:
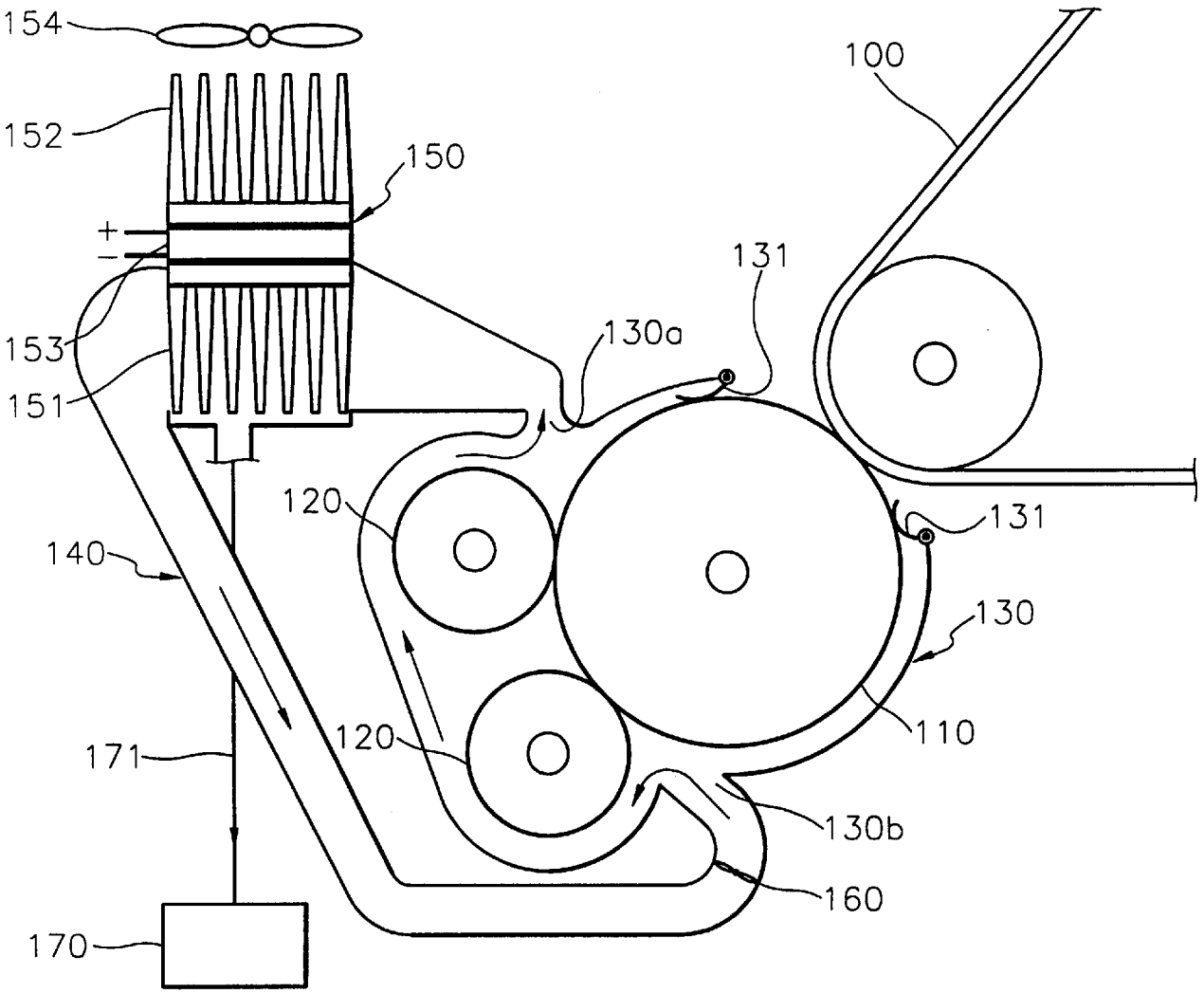
FIG. 3 illustrates a carrier recovery apparatus of a liquid electrophotographic printer according to a first embodiment of the present invention.

FIG. 3 illustrates a carrier recovery apparatus of a liquid electrophotographic printer according to a first embodiment of the present invention.

Referring to the drawing, a dry roller 110 being in contact with a photoreceptor belt 100, for absorbing a liquid carrier therefrom, and at least one heating roller 120 for heating the dry roller 110 and evaporating the carrier are rotatably installed in a manifold 130.

In the manifold 130, a circulation line 140 is connected to form a closed loop. Thus, a gas carrier exhausted through an outlet 130*a* by the driving of a driving fan 160 can be induced again into the manifold 130 through an inlet 130*b* via the circulation line 140, as indicated by arrows shown in the drawing.

In the circulation line 140, a condensing means 150 for cooling and condensing the moving gas carrier and transmitting the condensed carrier to a cartridge 170 is installed. In this embodiment, the condensing means 150 is constructed by a cooling portion having a plurality of cooling fins 151 for cooling and liquefying the carrier, a heat emitting portion 152 for emitting the heat absorbed from the cooling fins 151, a peltier chip 153 as a heat exchanging device interposed between the cooling fins 151 and the heat emitting portion 152, for performing heat exchange, and a cooling fan 154 for cooling the heat emitting portion 152. In FIG. 3, reference numeral 131 represents a sealing blade installed in the manifold 130 to be resiliently in close contact with the outer circumferential surface of the dry roller 110, for shielding a gap between the manifold 130 and the dry roller 110.

In the above-described configuration, the liquid carrier absorbed into the dry roller 110 from the photoreceptor belt 100 is evaporated into a gaseous state by the heating roller 120 and circulates in a direction indicated by arrows along the circulation line 140 by the driving of the driving fan 160. Some of the moving gas carrier contacts the cooling fins 151 maintained at a low temperature by the peltier chip 153, to then be cooled, condensed on the surface of the cooling fins 151 and then recovered in the cartridge 170 through a recovery line 171. The heat absorbed at the time of condensing the gas carrier is emitted through the heat emitting portion 152. The heat emitting portion 152 is consistently cooled by the cooling fan 154.

The gas carrier which is not condensed is induced into the manifold 130 while circulating along the circulation line and passes through the cooling fins 151 again. Thus, the gas carrier is condensed while continuously circulating along the closed loop by the circulation line 140 and the manifold 130, to then be recovered in the cartridge 170.

FIGS. 4 through 8 show various embodiments of the carrier recovery apparatus according to the present invention, in which the same reference numerals as those of the first embodiment represent the same elements.

Figure 4:
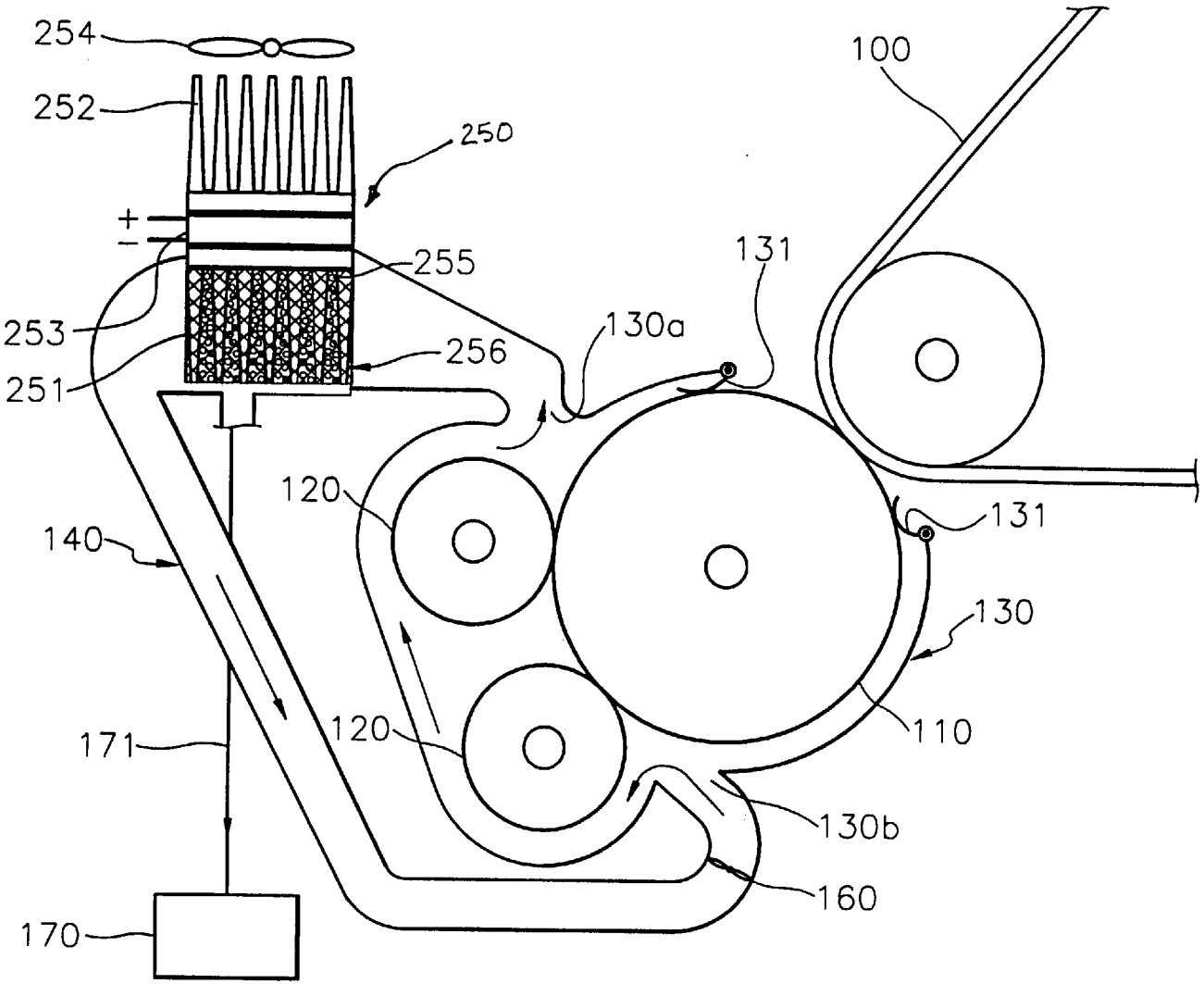
FIG. 4 illustrates a carrier recovery apparatus of a liquid electrophotographic printer according to a second embodiment of the present invention.

Referring to FIG. 4 illustrating a carrier recovery apparatus of a liquid electrophotographic printer according to a second embodiment of the present invention, a condensing means 250 for condensing a gas carrier includes a carrier cooling portion having a plurality of cooling fins 251, metal balls 255 installed between the cooling fins 251, a heat emitting portion 252 for emitting the heat absorbed by the cooling fins and the metal balls 255, a peltier chip 253 interposed between the cooling fins 251 and the heat emitting portion 252, for performing heat exchange, and a cooling fan 254 for cooling the heat emitting portion 252. Reference numeral 256 represent a mesh surrounding the carrier cooling portion so that the metal balls 255 may not be separated from the cooling fins 251.

The metal balls 255 are installed in the cooling fins 251 to increase the contact area of the carrier cooling portion with the gas carrier. In such a manner, the efficiency of cooling and recovery of the gas carrier can be increased.

Figure 5:
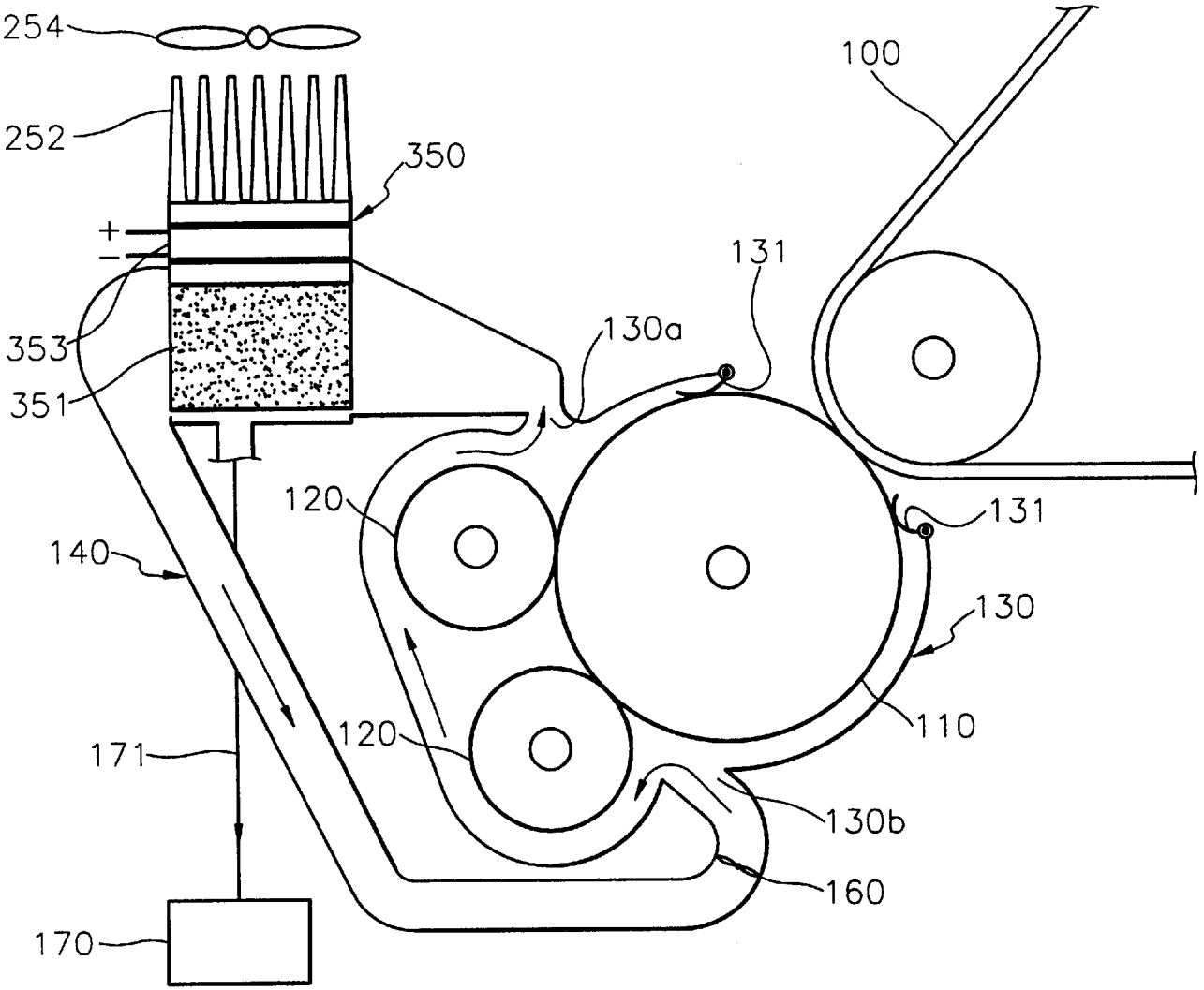
FIG. 5 illustrates a carrier recovery apparatus of a liquid electrophotographic printer according to a third embodiment of the present invention.

Referring to FIG. 5 illustrating a carrier recovery apparatus of a liquid electrophotographic printer according to a third embodiment of the present invention, the condensing means 250 includes, in addition to heat emitting portion 252 and cooling fan 254, a carrier cooling portion for cooling a gas carrier in contact with the same, and a metal sponge 351. The metal sponge 351 has a high heat conductivity and is a porous medium maintained at a low temperature by a peltier chip 353. Since the porous medium can increase the contact area with a gas carrier, it can improve the carrier cooling efficiency.

Figure 6:
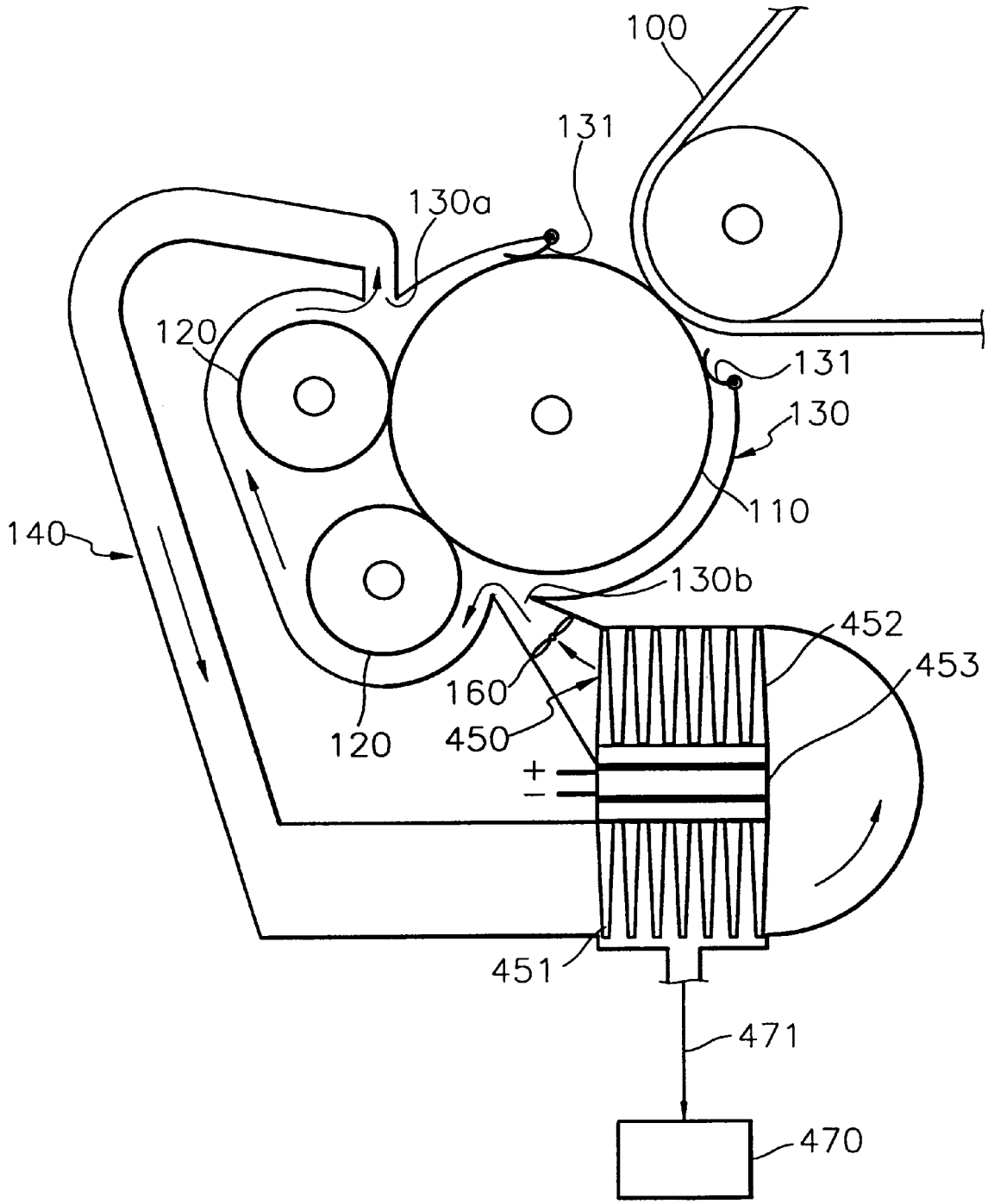
FIG. 6 illustrates a carrier recovery apparatus of a liquid electrophotographic printer according to a fourth embodiment of the present invention.

FIG. 6 illustrates a carrier recovery apparatus of a liquid electrophotographic printer according to a fourth embodiment of the present invention. In this embodiment, the air circulation path is improved so that a heat emitting portion 452 connected to a peltier chip 453 can be cooled without using a separate cooling fan.

Referring to the drawing, there is provided a condensing means 450 for cooling and condensing a gas carrier circulating along the circulation line 140 and transmitting the same to a cartridge 470. The condensing means 450 includes a carrier cooling portion having a plurality of cooling fins 451 for liquefying the gas carrier, a heat emitting portion 452 for emitting the heat absorbed during the cooling process, and a peltier chip 453 as a heat exchanging device installed between the cooling portion and the heat emitting portion 452, for performing heat exchange. The feature of this embodiment lies in that the cooling portion of the condensing means 450 is installed at the upstream side of the circulation line 140 and the heat emitting portion 452 is installed at the downstream side of the circulation line 140.

In the above-described configuration, the liquid carrier absorbed into the dry roller 110 from the photoreceptor belt 100 is evaporated into a gas state by the heating roller 120 and circulates in a direction indicated by the arrows along the circulation line 140 by the driving of the driving fan 160. During this process, the gas carrier first contacts the cooling portion, that is, the cooling fins 451 maintained at a low temperature by the peltier chip 453, to then be cooled and condensed. The heat absorbed during the condensing process is transmitted to the heat emitting portion 452. The condensed carrier is recovered in the cartridge 470 through a recovery line 471. Then, the gas carrier which is cooled while passing through the cooling fins 451 passes through the heat emitting portion 452 to cool the same and then is induced again into the manifold 130 through the inlet 130*b*. Since the gas induced through the inlet 130*b* has been warmed by heat exchange at the heat emitting portion 452, the efficiency of evaporating the carrier by the heating roller 120 can be further enhanced. According to this embodiment, since the heat emitting portion 452 is cooled by the air having been cooled while passing through the cooling fins 451, it is not necessary to install a separate cooling fan.

Figure 7:
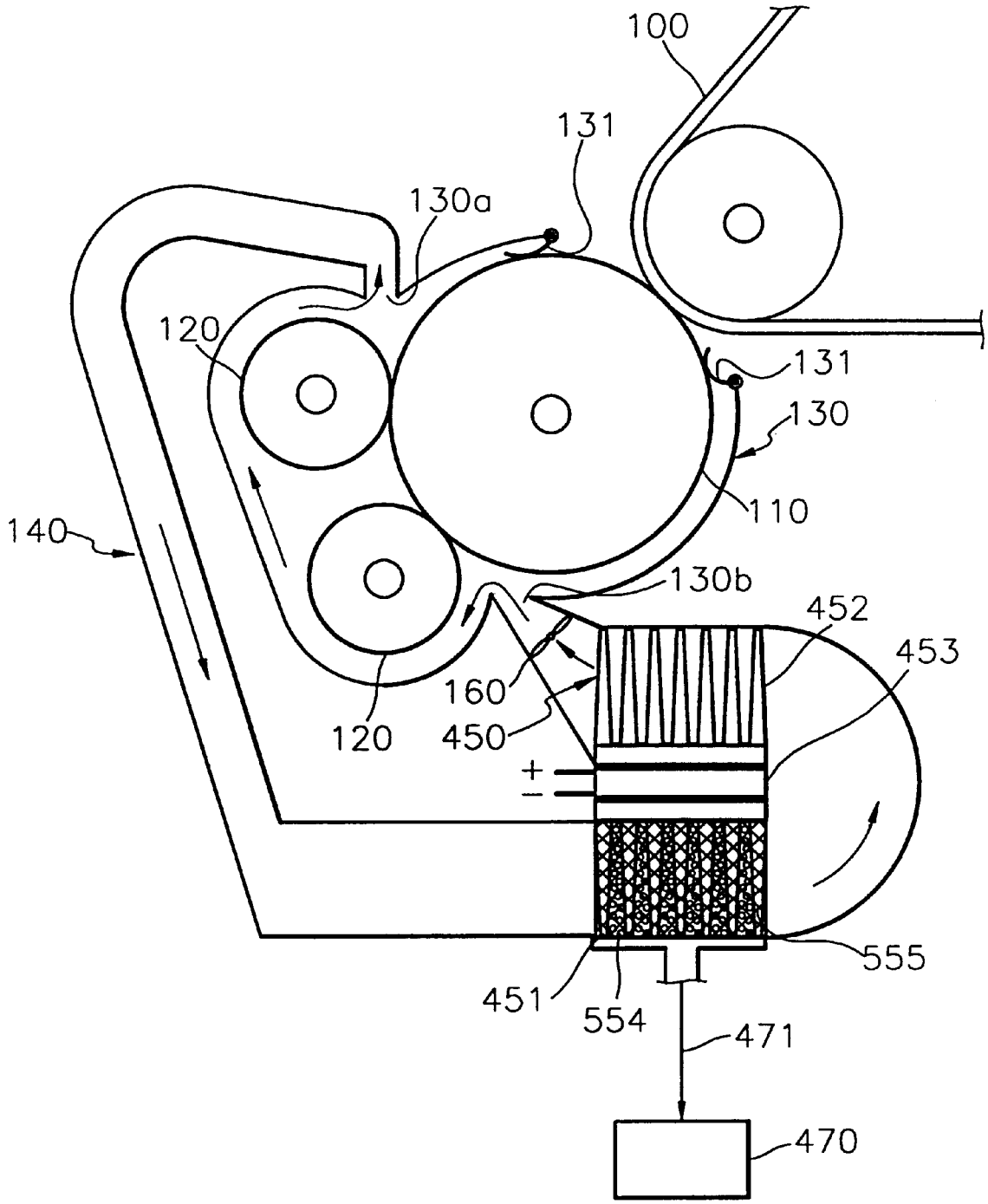
FIG. 7 illustrates a carrier recovery apparatus of a liquid electrophotographic printer according to a fifth embodiment of the present invention.

Alternatively, as shown in FIG. 7, metal balls 555 may be interposed between the cooling fins 451, to improve the efficiency of cooling and recovering the gas carrier by increasing the contact area between the gas carrier and the carrier cooling portion.

Reference numeral 554 represents a mesh surrounding the carrier cooling portion and preventing the metal balls 555 from being separated from the cooling fins 451.

Figure 8:
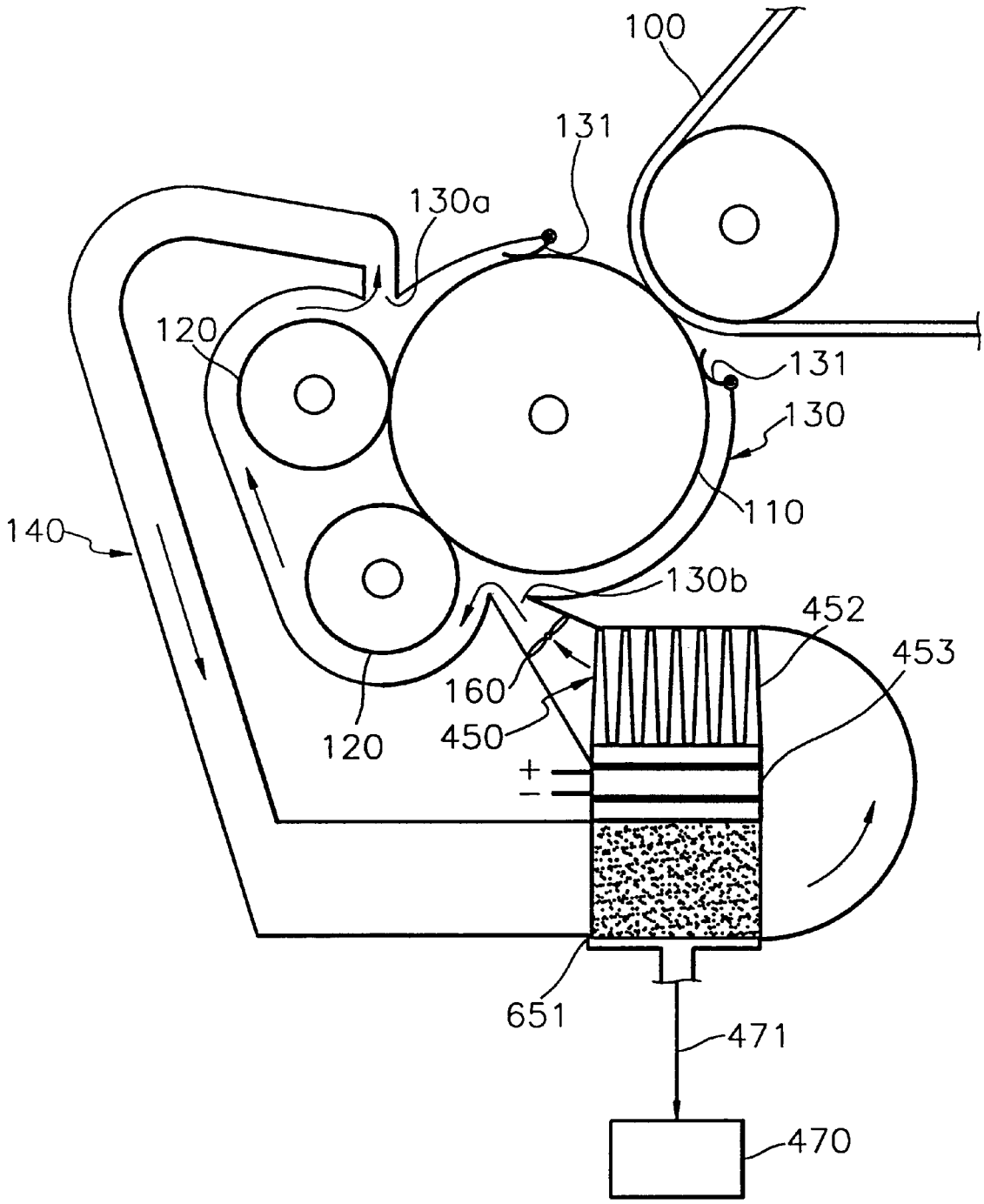
FIG. 8 illustrates a carrier recovery apparatus of a liquid electrophotographic printer according to a sixth embodiment of the present invention.

As shown in FIG. 8, the cooling portion can employ a porous medium having a high heat conductivity, e.g., a metal sponge 651. In this case, the efficiency of cooling the gas carrier can be improved by increasing the heat exchange area.

In the above-described embodiments, a peltier chip has been described to be installed between a heat emitting portion and cooling fins, not to be limited thereto, and it is obvious that a plurality of peltier chips may be installed.

Figure 9:
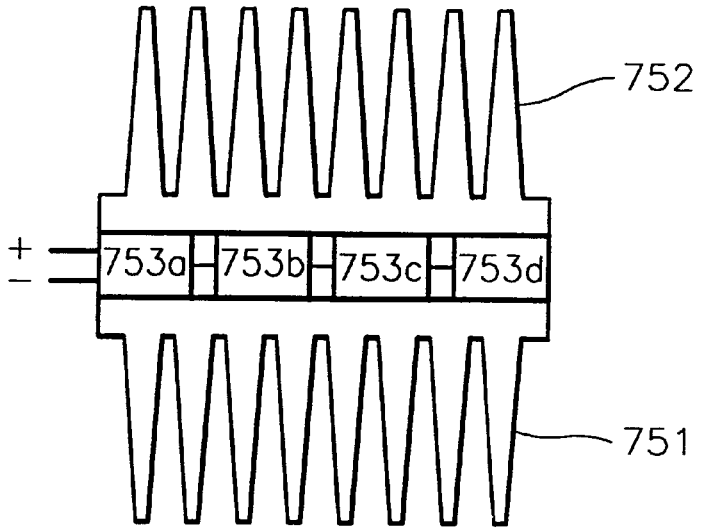
FIGS. 9 and 10 illustrate other examples of a peltier chip employed in the present invention.
Figure 10:
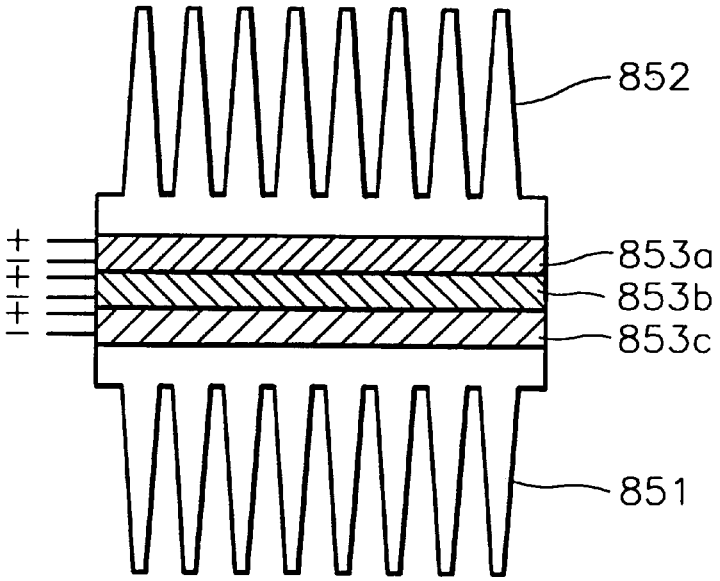

That is to say, as shown in FIG. 9, a plurality of peltier chips 753*a*, 753*b*, 754*c* and 754*d* are juxtaposed between cooling fins 751 and a heat emitting portion 752, so that energy consumption can be reduced to maintain a difference in temperatures of the cooling fins 751 and the heat emitting portion 752. Also, as shown in FIG. 10, a plurality of peltier chips 853*a*, 853*b* and 853*c* may be stacked between cooling fins 851 and a heat emitting portion 852. In this case, a temperature difference between the cooling fins 851 and the heat emitting portion 852 can be made large in proportion to the number of peltier chips stacked. Therefore, the pettier chips can be optionally arranged in consideration of cooling efficiency.

As described above, in the carrier recovery apparatus of a liquid electrophotographic printer according to the present invention, since a gas carrier evaporated from a manifold is cooled and recovered while it circulates along a closed loop, the efflux of carrier can be prevented.

It is contemplated that numerous modifications may be made to the apparatus and procedure of the invention without departing from the spirit and scope of the invention as defined in the following claims.

What is claimed is:

1. A carrier recovery apparatus of a liquid electrophotographic printer comprising:

a dry roller which contacts a photoreceptor belt, for absorbing a liquid carrier therefrom;

a heating roller for heating the dry roller and evaporating the carrier;

a manifold for hermetically sealing and surrounding the dry roller and the heating roller so as to accommodate the evaporated gas carrier;

a circulation line for connecting an outlet and an inlet formed in the manifold to form a closed loop, along which the gas carrier accommodated in the manifold circulates;

a driving fan for supplying a driving force which allows the gas carrier to circulate; and a condensing means installed in the circulation line, for cooling and condensing the circulating gas carrier and transmitting the condensed carrier to a cartridge.

2. The carrier recovery apparatus according to claim 1, wherein the condensing means comprises:

a carrier cooling portion for cooling and liquefying the gas carrier;

a heat emitting portion for emitting the heat absorbed from the carrier cooling portion; and a heat exchanging device interposed between the carrier cooling portion and the heat emitting portion, for performing heat exchange.

3. The carrier recovery apparatus according to claim 2, wherein the condensing means further comprises a cooling fan for cooling the heat emitting portion.

4. The carrier recovery apparatus according to claim 2, wherein the carrier cooling portion comprises a plurality of cooling fins.

5. The carrier recovery apparatus according to claim 4, wherein the carrier cooling portion further comprises metal balls installed between the cooling fins.

6. The carrier recovery apparatus according to claim 2, wherein the carrier cooling portion is formed of a porous medium having a high heat conductivity.

7. The carrier recovery apparatus according to claim 6, wherein the porous medium is a metal sponge.

8. The carrier recovery apparatus according to claim 2, wherein the heat exchanging device is a peltier chip.

9. The carrier recovery apparatus according to claim 2, wherein the carrier cooling portion is positioned at an upstream position of the circulation line and the heat emitting portion is positioned at a downstream position thereof.

10. The carrier recovery apparatus according to claim 9, wherein the carrier cooling portion comprises a plurality of cooling fins.

11. The carrier recovery apparatus according to claim 10, wherein the carrier cooling portion further comprises metal balls installed between the cooling fins.

12. The carrier recovery apparatus according to claim 9, wherein the carrier cooling portion is formed of a porous medium having a high heat conductivity.

13. The carrier recovery apparatus according to claim 12, wherein the porous medium is a metal sponge.

14. The carrier recovery apparatus according to claim 2, wherein the heat exchanging device is a plurality of peltier chips juxtaposed between the carrier cooling portion and the heat emitting portion.

15. The carrier recovery apparatus according to claim 2, wherein the heat exchanging device is a plurality of peltier chips stacked between the carrier cooling portion and the heat emitting portion.

16. The carrier recovery apparatus according to claim 14 or claim 15, wherein the carrier cooling portion comprises a plurality of cooling fins.

17. A carrier recovery apparatus of a liquid electrophotographic printer comprising:

a dry roller which contacts a photoreceptor belt, for absorbing a liquid carrier therefrom;

a heating roller for heating the dry roller and evaporating the carrier;

a manifold for hermetically sealing and surrounding the dry roller and the heating roller so as to accommodate the evaporated gas carrier;

a circulation line for connecting an outlet and an inlet formed in the manifold to form a closed loop, along which the gas carrier accommodated in the manifold circulates;

a driving fan for supplying a driving force which allows the gas carrier to circulate; and a condensing mechanism installed in the circulation line, for cooling and condensing the circulating gas carrier and transmitting the condensed carrier to a cartridge.

18. The carrier recovery apparatus according to claim 17, wherein the condensing mechanism comprises:

a carrier cooling portion for cooling and liquefying the gas carrier;

a heat emitting portion for emitting the heat absorbed from the carrier cooling portion; and a heat exchanging device interposed between the carrier cooling portion and the heat emitting portion, for performing heat exchange.

19. The carrier recovery apparatus according to claim 18, wherein the condensing means further comprises a cooling fan for cooling the heat emitting portion.

20. The carrier recovery apparatus according to claim 18, wherein the carrier cooling portion is positioned at an upstream position of the circulation line and the heat emitting portion is positioned at a downstream position thereof.

* * * * *